US011110698B2

(12) United States Patent
Tham et al.

(10) Patent No.: US 11,110,698 B2
(45) Date of Patent: Sep. 7, 2021

(54) SHEET GRIPPING MECHANISM AND PRINTER

(71) Applicant: TOSHIBA TEC KABUSHIKI KAISHA, Tokyo (JP)

(72) Inventors: Jun Yan Tham, Singapore Singapore (MY); Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/872,578

(22) Filed: May 12, 2020

(65) Prior Publication Data

US 2020/0269563 A1 Aug. 27, 2020

Related U.S. Application Data

(63) Continuation of application No. 15/683,569, filed on Aug. 22, 2017, now abandoned.

(30) Foreign Application Priority Data

Sep. 1, 2016 (JP) ..... 2016-170590

(51) Int. Cl.

| | |
|---|---|
| ***B41F 21/04*** | (2006.01) |
| ***B65H 35/00*** | (2006.01) |
| ***B65H 23/12*** | (2006.01) |
| *G07F 19/00* | (2006.01) |

(52) U.S. Cl.

CPC ..... *B41F 21/04* (2013.01); *B65H 23/12* (2013.01); *B65H 35/006* (2013.01); (Continued)

(58) Field of Classification Search

CPC ..... B41F 21/04; B65H 23/12; B65H 35/006; B65H 2404/511; B65H 2404/5211; (Continued)

(56) References Cited

U.S. PATENT DOCUMENTS

| | | | |
|---|---|---|---|
| 4,372,549 | A | 2/1983 | Stiernspetz |
| 4,373,549 | A | 2/1983 | Nalepa et al. |

(Continued)

FOREIGN PATENT DOCUMENTS

| | | | |
|---|---|---|---|
| JP | S60-19574 | A | 1/1985 |
| JP | S62-102647 | U | 6/1987 |

(Continued)

OTHER PUBLICATIONS

Japanese Notice of Reasons for Refusal dated Aug. 18, 2020 mailed in counterpart Japanese Patent Application No. 2016-170590, 8 pages (with Translation).

*Primary Examiner* — Matthew G Marini
*Assistant Examiner* — Marissa Ferguson-Samreth
(74) *Attorney, Agent, or Firm* — Kim & Stewart LLP

(57) ABSTRACT

A sheet gripping mechanism includes a first sheet guide including a guide surface facing a sheet conveyance path along which a sheet is to be conveyed and a second sheet guide which faces the first sheet guide across the sheet conveyance path. The second sheet guide includes a protuberance extending toward the first sheet guide, to locations beyond the guide surface formed by the first sheet guide. When a sheet is located between the first sheet guide and the protuberance of the second sheet guide, the protuberance extends at least a portion of the sheet toward the first sheet guide to bring a part of a surface of the sheet into contact with the first sheet guide.

16 Claims, 7 Drawing Sheets

(52) U.S. Cl.
CPC ..... *B65H 2404/511* (2013.01); *B65H 2404/5211* (2013.01); *B65H 2701/132* (2013.01); *B65H 2701/1936* (2013.01); *B65H 2801/12* (2013.01); *G07F 19/203* (2013.01)

(58) Field of Classification Search
CPC ..... B65H 2701/132; B65H 2701/1936; B65H 2801/12; B65H 23/26; B65H 29/52; B65H 29/70; B65H 2404/74; B65H 2404/742; G07F 19/203
See application file for complete search history.

(56) References Cited

U.S. PATENT DOCUMENTS

| | | | |
|---|---|---|---|
| 5,139,351 | A | 8/1992 | Kamada |
| 5,583,664 | A | 12/1996 | Sanpei |
| 6,602,008 | B2 | 8/2003 | Yamagishi et al. |
| 8,292,526 | B2 | 10/2012 | Sakai |
| 2002/0020962 | A1 | 2/2002 | Takeda |
| 2007/0065217 | A1 | 3/2007 | Yoshioka |
| 2018/0060852 | A1 | 3/2018 | Eoka et al. |

FOREIGN PATENT DOCUMENTS

| | | | | | |
|---|---|---|---|---|---|
| JP | H01-067054 | U | | 4/1989 | |
| JP | H06-023955 | U | | 3/1994 | |
| JP | H08-157126 | A | | 6/1996 | |
| JP | H08-310067 | A | | 11/1996 | |
| JP | H09-234924 | A | | 9/1997 | |
| JP | 2002-302314 | A | | 10/2002 | |
| JP | 2016069136 | | * | 5/2016 | ..... B65H 31/26 |

* cited by examiner

SHEET GRIPPING MECHANISM AND PRINTER

CROSS-REFERENCE TO RELATED APPLICATIONS

This application is a continuation of U.S. patent application Ser. No. 15/683,569, filed on Aug. 22, 2017, which is based upon and claims the benefit of priority from Japanese Patent Application No. 2016-170590, filed on Sep. 1, 2016, the entire contents of each of which are incorporated herein by reference.

FIELD

Embodiments described herein relate generally to a sheet gripping mechanism and a printer.

BACKGROUND

An apparatus such as a merchandise information processing apparatus (for example, a point of sales (POS) terminal) or a financial information processing apparatus, for example, an automated teller machine or ATM, is equipped with a printer that prints, for example, information concerning a transaction performed therewith. Such an apparatus is provided with a discharge port for sheets printed thereby. The printer prints, for example, transaction details on a sheet and then conveys the sheet toward the discharge port.

The sheet conveyed to the discharge port is required to be held at the discharge port in order to prevent the sheet from falling down to the outside of the apparatus or the inside of the apparatus before being picked up by the user. If any conveyance mechanism (for example, a conveyance belt and a conveyance roller) is arranged in the vicinity of the discharge port, the apparatus is able to hold the sheet at the discharge port by clamping the sheet between the conveyance belt and the conveyance roller. However, depending on the design of the apparatus, the conveyance mechanism is not always present in the vicinity of the discharge port. Moreover, it is difficult, in terms of cost, to arrange a structurally-complex mechanism at the discharge port only for the purpose of holding the sheet.

DETAILED DESCRIPTION

Figure 1:
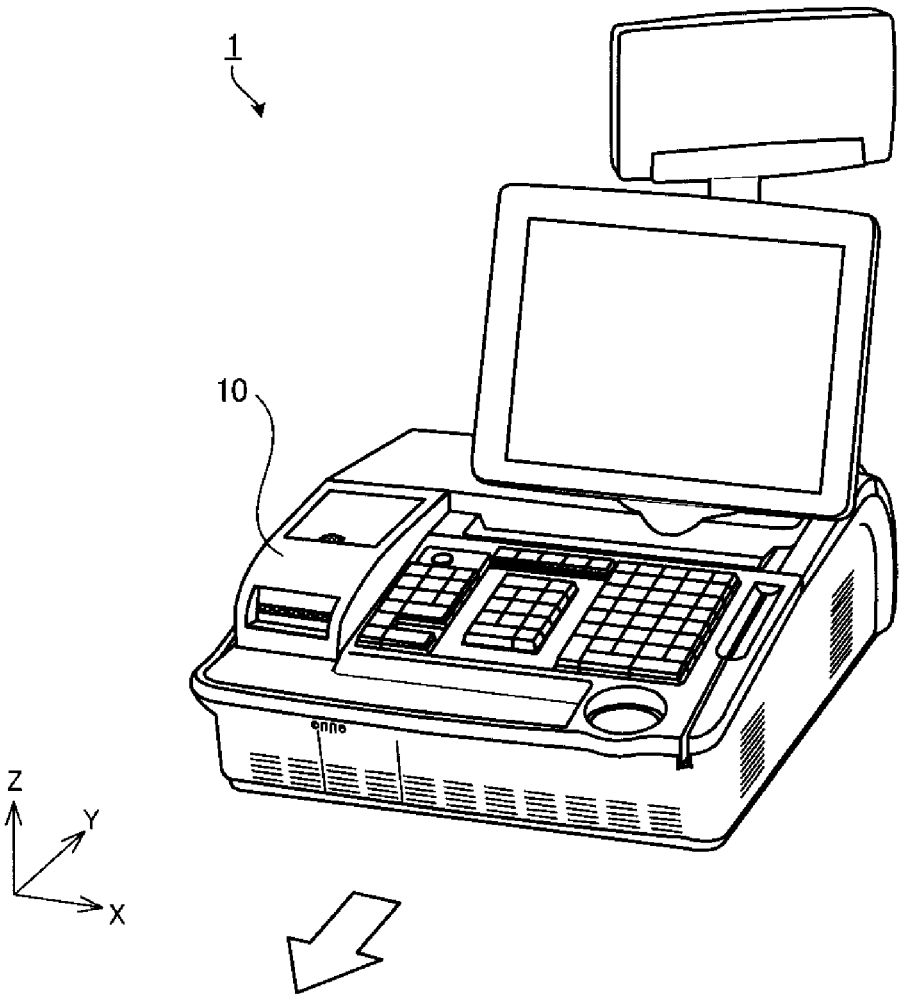
FIG. 1 is a perspective view illustrating a merchandise information processing apparatus equipped with a printer according to an embodiment.

Embodiments provide a sheet gripping mechanism with a simple configuration.

In general, according to one embodiment, a sheet gripping mechanism includes a first sheet guide including a guide surface facing a sheet conveyance path along which a sheet is to be conveyed and a second sheet guide which faces the first sheet guide across the sheet conveyance path. The second sheet guide includes a protuberance extending toward the first sheet guide, to locations beyond the guide surface formed by the first sheet guide. When a sheet is located between the first sheet guide and the protuberance of the second sheet guide, the protuberance extends at least a portion of the sheet toward the first sheet guide to bring a part of a surface of the sheet into contact with the first sheet guide.

Hereinafter, illustrative embodiments will be described with reference to the drawings. Furthermore, in the drawings, the same or similar components are assigned the respective same reference characters.

FIG. 1 is a perspective view illustrating a merchandise information processing apparatus 1 equipped with a printer 10 according to an embodiment. The merchandise information processing apparatus 1 is, for example, a point of sales (POS) terminal. The merchandise information processing apparatus 1 is installed in a retail or other sales establishment and is operated by an operator. The merchandise information processing apparatus 1 is connected to a store server (e.g., POS server) (not illustrated) via a network. The printer 10 may be attached to or incorporated in the merchandise information processing apparatus 1.

Furthermore, in the following description, an orthogonal coordinate system configured with an X-axis, a Y-axis, and a Z-axis is used. In the drawings, the direction indicated by an arrow is a plus direction. The X-axis plus direction is the rightward direction in FIG. 1, and the X-axis minus direction is the leftward direction. Moreover, the Y-axis plus direction is the rearward direction (back), and the Y-axis minus direction is the frontward direction (forward). Additionally, the Z-axis plus direction is the up direction, and the Z-axis minus direction is the down direction. The term "front" refers to the side of a device on which the operator is positioned. In the example illustrated in FIG. 1, the frontwardly facing direction is a direction indicated by an open outlined arrow.

Figure 2:
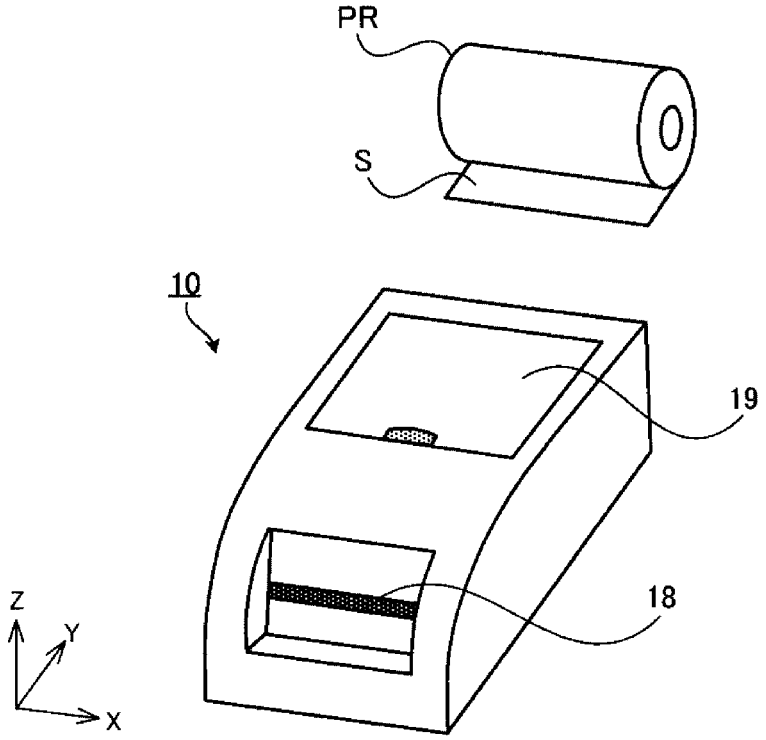
FIG. 2 is a perspective view of the printer according to the embodiment.

FIG. 2 illustrates the printer 10 of the merchandise information processing apparatus 1. The printer 10 is a receipt printer used to print and issue a receipt for a transaction. The printer 10 is equipped with a cover 19 at an upper portion thereof, and a roll of paper PR can be loaded to the interior thereof by opening the cover 19. The roll of paper PR is a roll-shaped printing medium in which a sheet S is rolled into a roll. The printer 10 draws the sheet S from the roll of paper PR and prints information about, for example, the transaction details on the sheet S. The printer 10 includes a discharge port 18 through which to discharge the printed sheet S. The discharge port 18 is formed in the side wall of the printer 10 so as to eject the sheet S toward the front thereof. Furthermore, the appearance of the printer 10 illustrated in FIG. 1 and FIG. 2 is merely an example, and the appearance can be modified in various manners.

Figure 3:
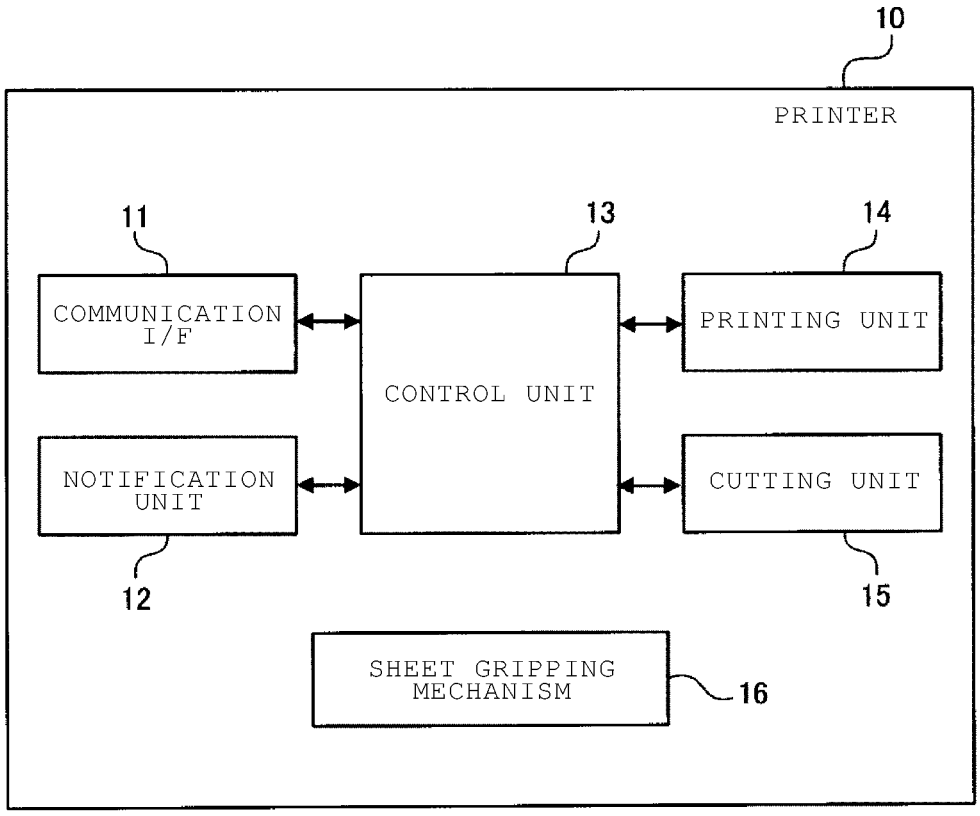
FIG. 3 is a block diagram illustrating components of the printer according to the embodiment.

FIG. 3 is a block diagram illustrating components of the printer 10. The printer 10 includes a communication interface 11, a notification unit 12, a control unit 13, a printing unit 14, a cutting unit 15, and a sheet gripping mechanism 16.

The communication interface 11 communicates with a control device (for example, a processor) of the merchandise information processing apparatus 1. The communication interface 11 acquires various pieces of data from the merchandise information processing apparatus 1. Data which the communication interface 11 acquires from the merchandise information processing apparatus 1 includes information which the printing unit 14 prints on the sheet S (for example, transaction details).

The notification unit 12 is an output device used to inform the user of information. The notification unit 12 is, for example, a sound-generating apparatus, such as a loudspeaker or a buzzer. The notification unit 12 can be a display device, such as a liquid crystal display or an organic electroluminescence (EL) display. The notification unit 12 informs the user of the occurrence of an abnormality, such as the occurrence of a conveyance abnormality of the sheet through the printer 10.

The control unit 13 is configured with a processing device such as a processor. The control unit 13 functions as a control device that controls each unit of the printer 10. The control unit 13 operates according to programs stored in a read-only memory (ROM) or a random access memory (RAM) inside the control unit 13 or outside the control unit 13, thus implementing various operations, such as conveyance control for the sheet S.

Figure 4:
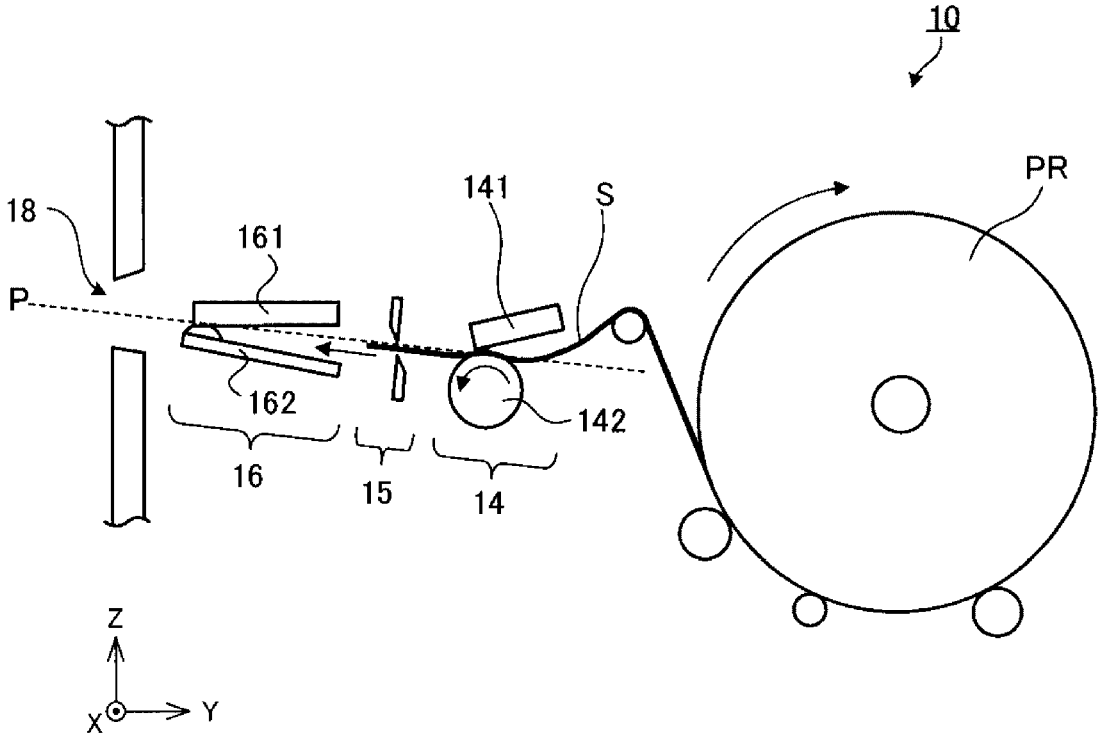
FIG. 4 is a diagram partially illustrating an internal structure of the printer according to the embodiment.

FIG. 4 is a diagram partially illustrating an internal structure of the printer 10. The printer 10 is configured to allow the roll of paper PR to be attached thereto and detached therefrom. The sheet S drawn from the roll of paper PR passes through a sheet conveyance path P and is then ejected from the discharge port 18. In the printer 10, the printing unit 14, the cutting unit 15, and the sheet gripping mechanism 16 are arranged along the conveyance path P.

The printing unit 14 prints various elements of information, such as transaction details, on the sheet S. The printing unit 14 is a thermal-type print unit. The printing unit 14 includes a print head 141 and a roller 142. The print head 141 is a thermal head, and the roller 142 is a platen roller which pushes the sheet S against the print head 141. The roller 142 also serves as a conveyance unit that conveys the sheet S. The printing unit 14 prints information, such as transaction details, on the sheet S according to control thereof by the control unit 13.

The cutting unit 15 is a cutter used to cut off a printing-completed portion (for example, a portion which is serves as a receipt) from the sheet S. The cutting unit 15 can be a slide-type cutter or a roller-type cutter. In FIG. 4, a slide-type cutter is illustrated as an example of the cutting unit 15. Naturally, the configuration of the cutting unit 15 is not limited to this, but can be modified in various manners.

The sheet gripping mechanism 16 is a mechanism configured to hold the sheet S in the vicinity of the discharge port 18. The sheet gripping mechanism 16 is located in front of the discharge port 18 (on the upstream side of the discharge port 18 in the conveyance direction). The sheet gripping mechanism 16 grips the sheet S to hold the sheet S at the discharge port 18.

Figure 5:
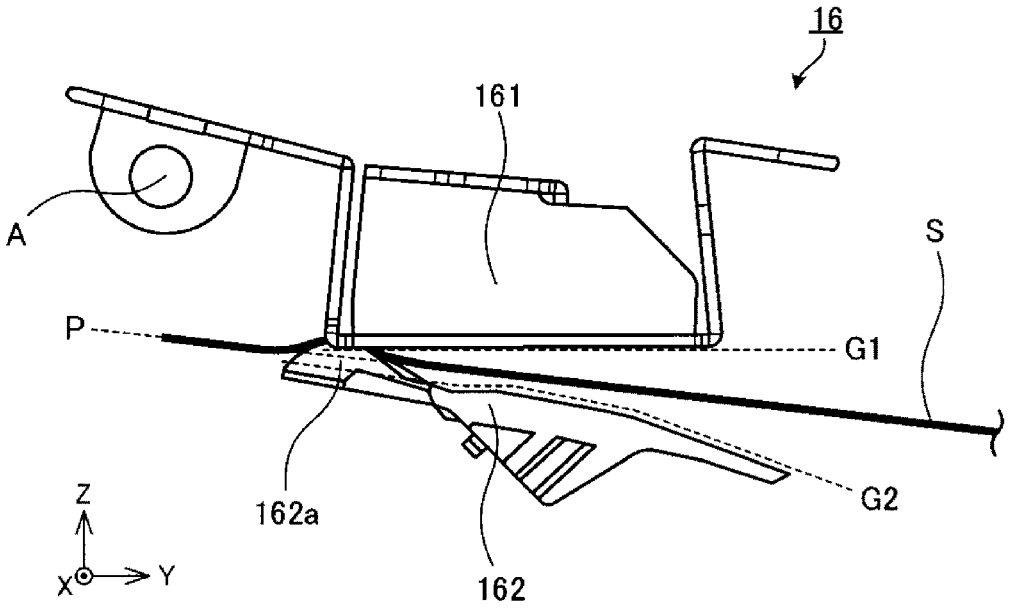
FIG. 5 is a diagram illustrating a configuration example of a sheet gripping mechanism.
Figure 6:
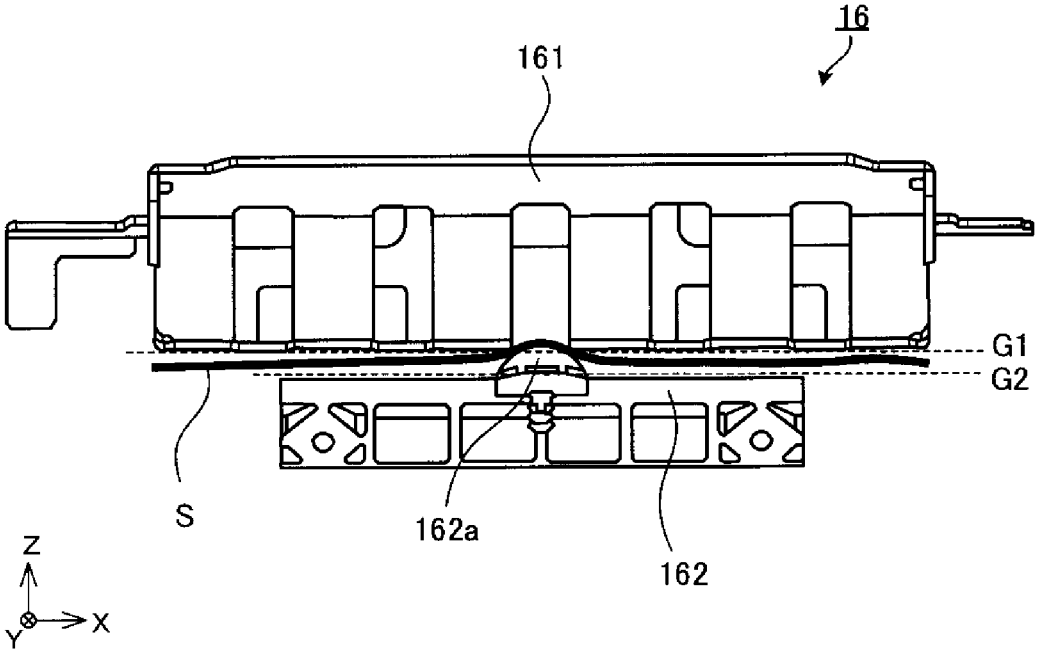
FIG. 6 is a diagram illustrating the configuration example of the sheet gripping mechanism.
Figure 7:
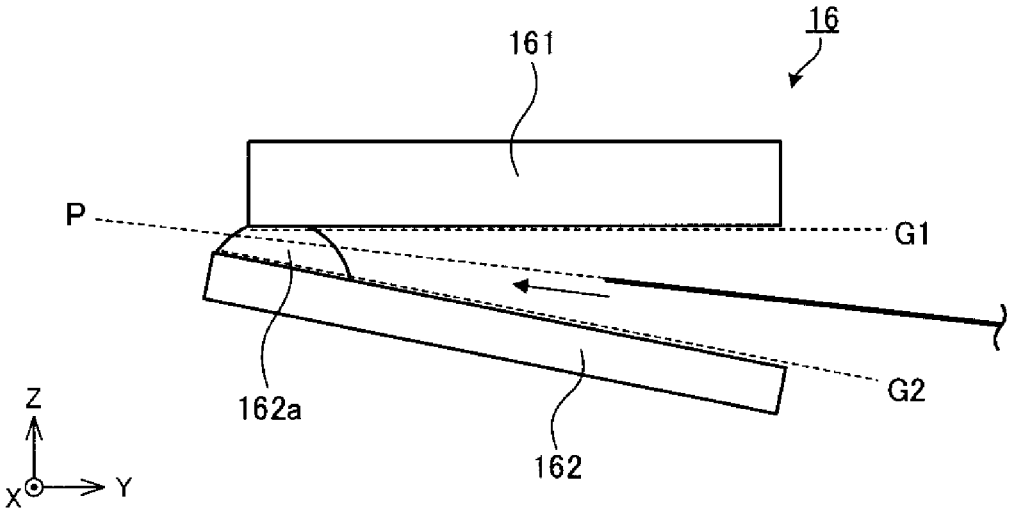
FIG. 7 is a diagram illustrating the sheet gripping mechanism as viewed from the right side.
Figure 8:
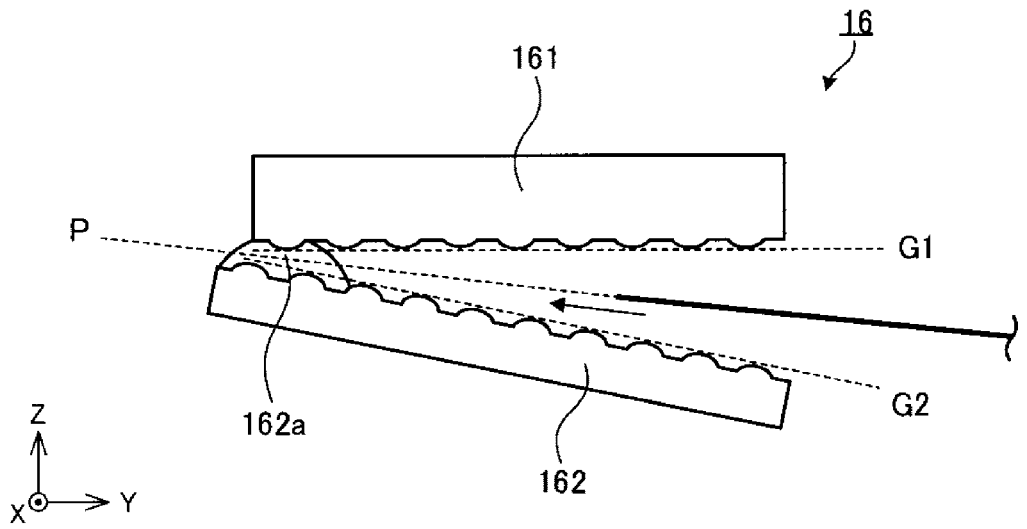
FIG. 8 is a diagram illustrating a modification example of the sheet gripping mechanism illustrated in FIG. 7.

FIG. 5 and FIG. 6 are diagrams illustrating a configuration example of the sheet gripping mechanism 16. FIG. 5 is a diagram illustrating the sheet gripping mechanism 16 as viewed from the right side, and FIG. 6 is a diagram illustrating the sheet gripping mechanism 16 as viewed from the front side. FIG. 7 and FIG. 8 are simplified diagrams illustrating a modification example of the sheet gripping mechanism 16 illustrated in FIG. 5 and FIG. 6. In the following description, for ease of understanding, a configuration of the sheet gripping mechanism 16 is described with reference to the simplified diagrams.

FIG. 7 is a diagram illustrating the sheet gripping mechanism 16 as viewed from the right side. The sheet gripping mechanism 16 includes a sheet guide 161 and a sheet guide 162. The sheet guide 161 and the sheet guide 162 are located in such a way as to face each other across the sheet conveyance path P located therebetween. The sheet guide 161 is located in such a way as to face one surface of the sheet S (in the present embodiment, an upper surface), and the sheet guide 162 is located in such away as to face the other surface of the sheet S (in the present embodiment, a lower surface). The sheet guide 161 and the sheet guide 162 each are inclined relative to the sheet conveyance path P in such a manner that the distance between them becomes gradually smaller in the sheet conveyance direction (toward the side of the discharge port 18).

The sheet guides 161 and 162 form guide surfaces G1 and G2, respectively. The guide surface G1 is formed on the sheet guide 161, and the guide surface G2 is formed on the sheet guide 162. Here, the term "guide surface" refers to a surface that guides a sheet S as it moves in the forward direction. A region of each of the sheet guides 161 and 162 facing the sheet S (hereinafter referred to as a "facing region") is formed as a planar portion. Therefore, in the case of the example illustrated in FIG. 7, the planar portions themselves of the sheet guides 161 and 162 serve as the guide surfaces G1 and G2.

Furthermore, the facing region serving as a guide surface does not necessarily need to be a planar surface. For example, the facing region can be in an undulating shape as illustrated in FIG. 8. In this case, an interrupted surface formed by connecting protruded portions (e.g., points, lines, or surfaces) which contact the sheet S each serve as one of the guide surfaces G1 and G2. The guide surface G1 or G2 is not limited to a planar surface, but can be a curved surface. In the above-mentioned example illustrated in FIG. 5, the guide surface G2 is formed as a curved surface. Furthermore, while, in FIG. 8, protruding portions in an undulating shape as viewed from the right side are provided, the protruding portions do not need to be limited to this configuration, but protruding portions in an undulating shape as viewed from the front side can be provided.

Figure 9:
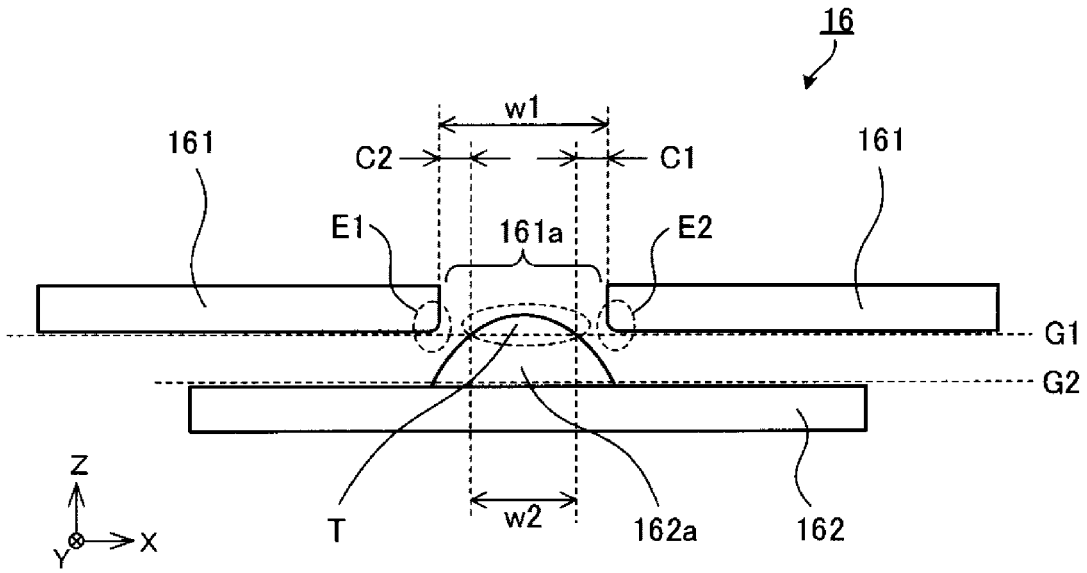
FIG. 9 is a diagram illustrating the sheet gripping mechanism illustrated in FIG. 7 as viewed from the front side.

FIG. 9 is a diagram illustrating the sheet gripping mechanism 16 illustrated in FIG. 7 as viewed from the front. An opening 161*a* which is a part of the guide surface G1 and which is open on the guide surface G1 in a direction perpendicular to the guide surface G1 (in the present embodiment, upwardly) is formed in the sheet guide 161. A protuberance 162*a* protruding toward the sheet guide 161 is provided on the sheet guide 162. The protuberance 162*a* is located at a position facing the opening 161*a*. The protuberance 162*a* serves as a portion that bends the sheet S toward the sheet guide 161.

The shape of the protuberance 162*a* can be optionally changed. In FIG. 9, the protuberance 162*a* is formed as a mountain-like convex portion. Apart of the protuberance 162*a* (in the present embodiment, a top portion T) is located on the side of the sheet guide 161 beyond the guide surface G1. In other words, the top portion T of the protuberance 162*a* is positioned within the opening 161*a*. In the present embodiment, the top portion T contacts the sheet S. The top portion T is formed as a curved surface so as not to damage the sheet S. In the X-axis direction, the width w1 of the opening 161*a* is greater than the width w2 of the top portion T of the protuberance 162*a*. Therefore, clearances C1 and C2, through which the sheet S is able to pass, are formed between edge portions E1 and E2 of the opening 161*a* and the protuberance 162*a* as shown in FIG. 9.

Next, an operation of the printer 10 having the above-described configuration is described.

The control unit 13 controls the printing unit 14 to print information, such as transaction details, on the sheet S. Then, the control unit 13 controls the roller 142 to convey the sheet S until a part of the sheet S extends from the discharge port 18. At this time, the control unit 13 controls the cutting unit 15 to cut off a printing-completed portion of the sheet S as a receipt.

Figure 10:
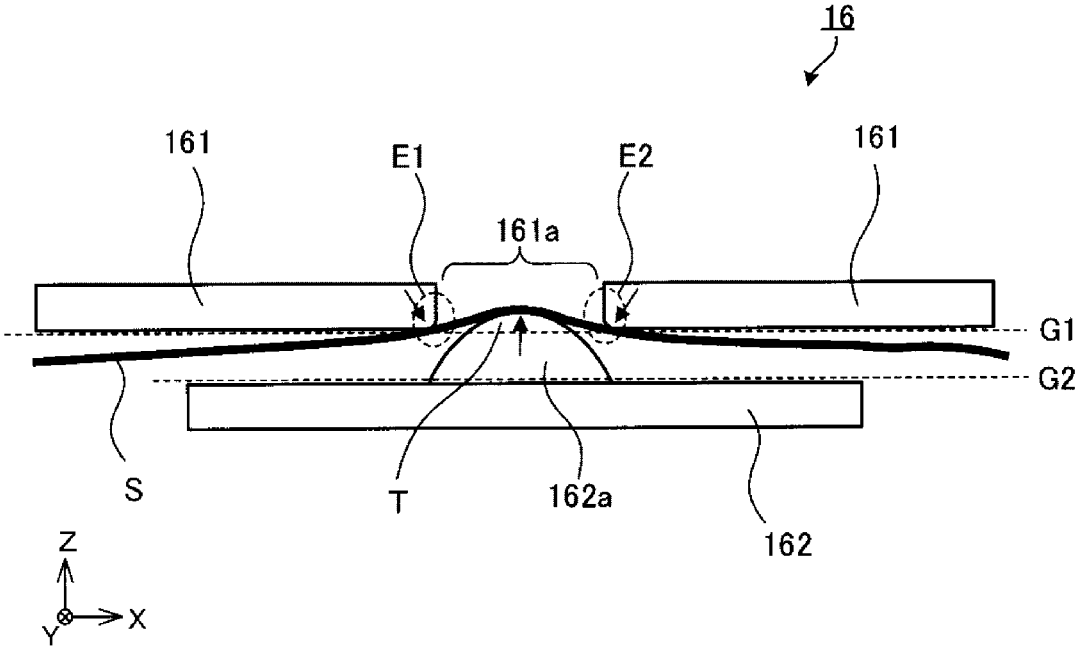
FIG. 10 is a diagram illustrating a condition in which a sheet is located between two sheet guides.

According to conveyance control performed by the control unit 13, the sheet S is conveyed along the sheet conveyance path P and arrives at the sheet gripping mechanism 16. Then, the sheet S is located between the sheet guide 161 and the sheet guide 162. FIG. 10 is a diagram illustrating a condition in which the sheet S is located between the sheet guide 161 and the sheet guide 162.

As is understandable from FIG. 10, the sheet S is located between the guide surface G1 and the guide surface G2 at other than the opening 161*a*. On the other hand, at the opening 161*a*, the sheet S is located on the side of the sheet guide 161 above or beyond the plane of the guide surface G1 (on the Z-axis plus direction side). More specifically, the sheet S passes through the clearances C1 and C2 from a space between the guide surface G1 and the guide surface G2 on the rear side in FIG. 10, and then arrives at the top portion T of the protuberance 162*a*. As illustrated in FIG. 10, the sheet S enters a state of being bent by the protuberance 162*a* such that the center portion of the sheet S in the X-axis direction is elevated toward the sheet guide 161.

Furthermore, even when the sheet S is bent by the protuberance 162*a*, the shape of the sheet S does not coincide with the shape of the protuberance 162*a*. Since paper has stiffness (also called strength or rigidity), the sheet S is raised off the surface G2 in a gentle curved manner with the top portion T as an apex. A part of the sheet S is caused, by an upward pressure due to the stiffness of the sheet S, to contact the sheet guide 161 while applying pressure thereto. In the present embodiment, the sheet S is in contact with the edge portions E1 and E2 of the opening 161*a* while pressure is applied to the edge portions E1 and E2 because of the stiffness of the sheet S. In the following description, the contact in a state in which pressure is applied is referred to as "pressure contact". Furthermore, in the edge portion E1 or E2, a portion which contacts the sheet S can be curved so as not to damage the sheet S.

According to the pressure contact, at the edge portions E1 and E2, pressure is applied to the sheet S in a direction in which the sheet guide 162 is present (in the present embodiment, the obliquely downward direction in FIG. 10). On the other hand, at the protuberance 162*a*, pressure is applied to the sheet S in a direction in which the sheet guide 161 is present (in the present embodiment, the upward direction in FIG. 10). Therefore, when located between the sheet guide 161 and the sheet guide 162, the sheet S enters a state of being slightly gripped on both surfaces thereof by the edge portions E1 and E2 and the top portion T. Since static frictional force occurs between the upper surface of the sheet S and the edge portions E1 and E2, and between the lower surface of the sheet S and the top portion T, the sheet S is held at the sheet gripping mechanism 16. As a result, the sheet S is lightly gripped with a part thereof exposed from the discharge port 18.

According to the present embodiment, the sheet S can be gripped in the vicinity of the discharge port 18 with an extremely simple configuration. Since the sheet gripping mechanism 16 has an extremely simple configuration, which is configured with the sheet guide 161 and the sheet guide 162, the cost of the arrangement of the sheet gripping mechanism 16 in the printer 10 is low. Moreover, no complicated operation is required to grip the sheet S. Since the sheet gripping mechanism 16 grips the sheet S without being controlled by the control unit 13, the designer is not required to separately create software for mechanical control. Therefore, the cost of designing of the printer 10 is also low.

Furthermore, the sheet S is only lightly gripped by the sheet gripping mechanism 16. Therefore, the control unit 13 is able to adjust the amount of extension of the sheet S from the discharge port 18 only by continuing conveyance of the sheet S. When adjusting the amount of extension of the sheet S, the control unit 13 does not need to control the sheet gripping mechanism 16 separately from a conveyance unit. Moreover, since the sheet S is only lightly gripped by the sheet gripping mechanism 16, the user can smoothly take the sheet S from the discharge port 18.

The above-described embodiment is merely an example, and can be modified in various manners and applied to various usages.

For example, in the above-described embodiment, the sheet guide 161, in which the opening 161*a* is formed, is located on the same side of the sheet conveyance path P as the print head 141 (on the Z-axis plus direction side). In other words, the opening 161*a* of the sheet guide 161 is located in such a way as to face a printing surface of the sheet S. However, the opening 161*a* of the sheet guide 161 can be located in such a way as to face a non-printing surface of the sheet S. The non-printing surface is a surface on which printing is not performed out of two, front and back, surfaces of the sheet S.

Figure 11:
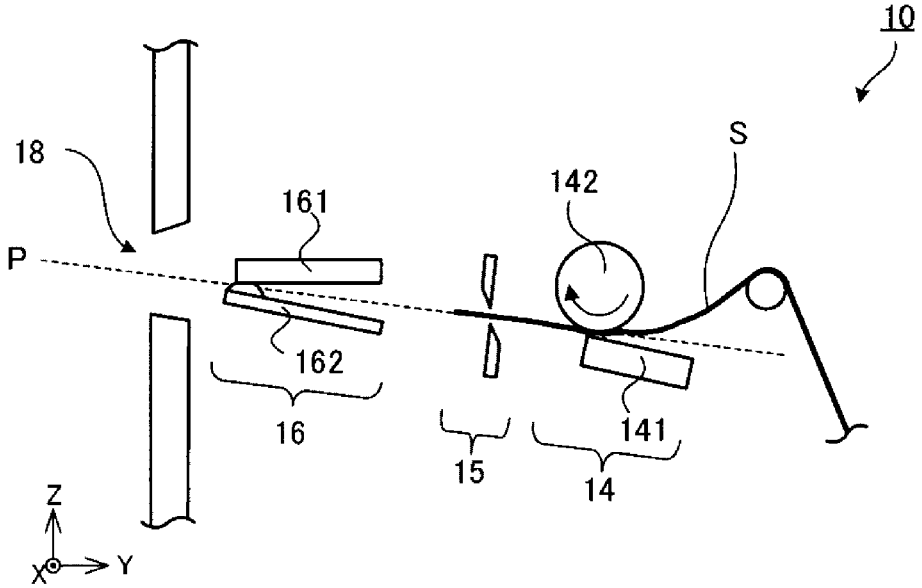
FIGS. 11-13 are different views of a modification example of the sheet gripping mechanism.

FIG. 11 illustrates a condition in which the opening 161*a* of the sheet guide 161 is located in such a way as to face a non-printing surface of the sheet S. In the example illustrated in FIG. 11, the sheet guide 161 is located on the same side of the sheet conveyance path P as the roller 142 in such a manner that the opening 161*a* of the sheet guide 161 faces a non-printing surface of the sheet S. With this configuration, since the edge portions E1 and E2 of the opening 161*a* do not come into pressure contact with a recording region of the sheet S, characters printed on the sheet S are unlikely to become illegible due to damage from the gripping mechanism 16. In particular, in a case where the sheet S is thermal paper, a phenomenon in which a line appears in a printing region due to a pressure imposed on the edge portions E1 and E2 can be reduced. The recording region refers to a region excluding the left, right, top, and bottom margin regions in the printing surface of the sheet S.

Figure 12:
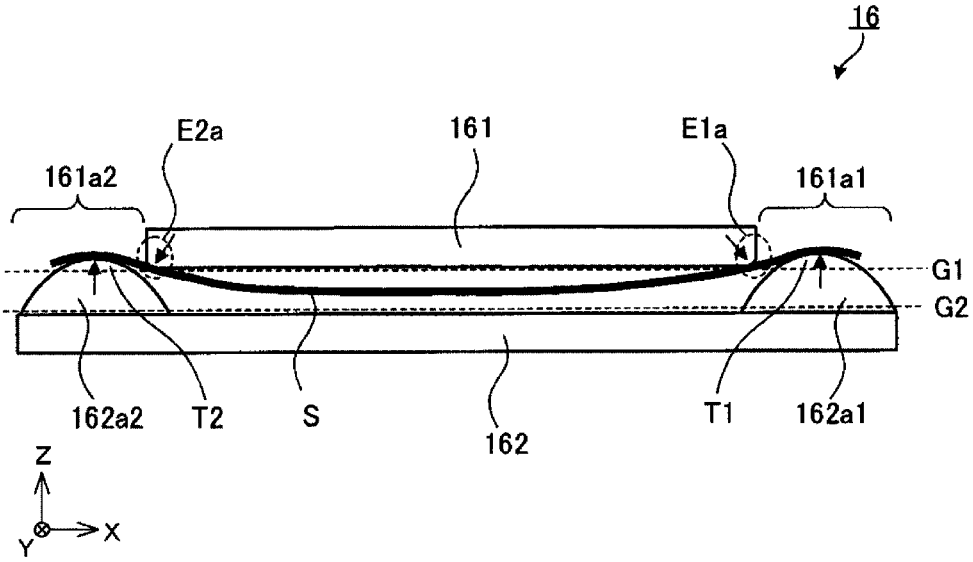
Figure 13:
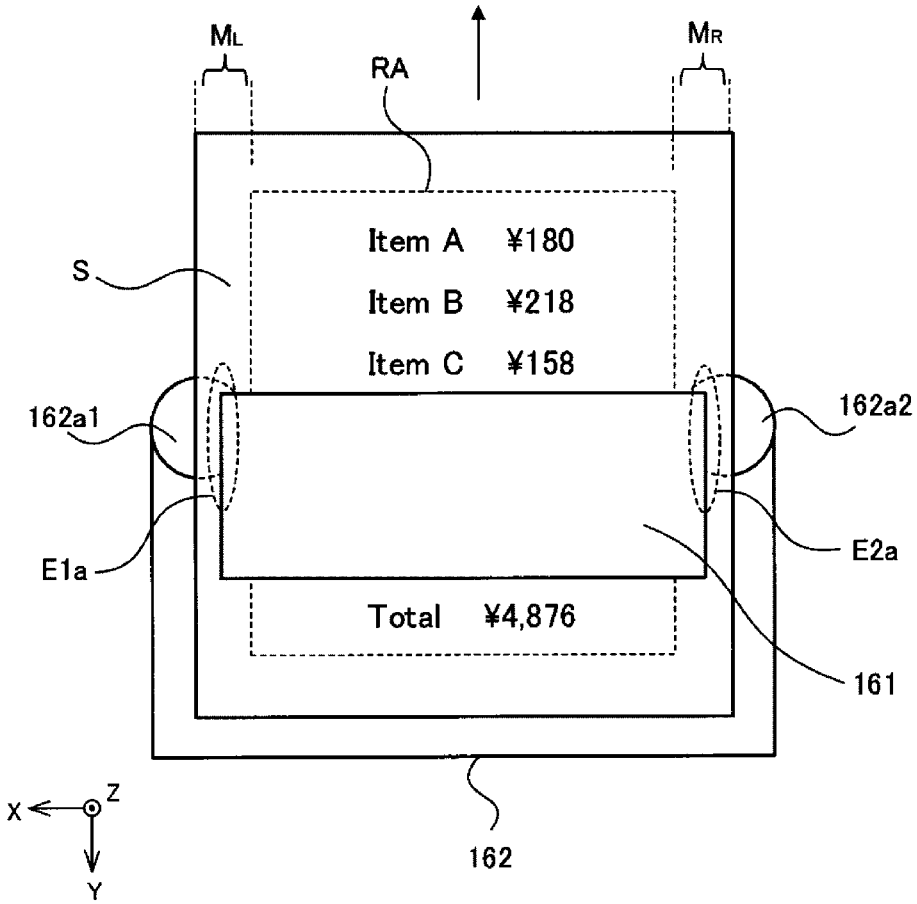

Furthermore, the sheet guide 161 can be located in such a way as to face a non-recording region other than the non-printing surface. FIG. 12 and FIG. 13 are diagrams illustrating a condition in which openings of the sheet guide 161 are located in such a way as to face a non-recording region of the sheet S. FIG. 12 is a diagram illustrating the sheet gripping mechanism 16 as viewed from the front, and FIG. 13 is a diagram illustrating the sheet gripping mechanism 16 as viewed from above. The sheet guide 161 has two openings (161*a*1 and 161*a*2 illustrated in FIG. 12). The openings 161*a*1 and 161*a*2 are located at the respective ends of the sheet guide 161 in the X-axis direction in such a way as to face margin regions of the sheet S. More specifically, the opening 161*a*1 is located in such away as to face a left margin region $M_L$, and the opening 161*a*2 is located in such away as to face a right margin region $M_R$. The openings 161*a*1 and 161*a*2 can be gaps formed between the sheet guide 161 and a casing of the printer 10.

Furthermore, the sheet guide 162 has two protuberances (162*a*1 and 162*a*2 illustrated in FIG. 12 and FIG. 13). The protuberances 162*a*1 and 162*a*2 are located at positions facing the openings 161*a*1 and 161*a*2, respectively. The top portion T1 of the protuberance 162*a*1 extends into the opening 161*a*1 beyond the guide surface G1, and the top portion T2 of the protuberance 162*a*2 extends into the opening 161*a*2 beyond the guide surface G1. When the sheet S is located between the sheet guide 161 and the sheet guide 162, the edge portion E1*a* of the opening 161*a*1 and the edge portion E2*a* of the opening 161*a*2 come into pressure contact with the margin regions $M_L$ and $M_R$ of the sheet S, respectively, as illustrated in FIG. 13. Since the regions with which the edge portions E1*a* and E2*a* come into pressure contact are not a recording region of the sheet S, characters printed on the sheet S are unlikely to become illegible due to damage. Additionally, the non-recording region refers to a region excluding a recording region RA in the surfaces of the sheet S. More specifically, the non-recording region refers to a non-printing surface and left, right, top, and bottom margin regions of a printing surface of the sheet S.

Furthermore, the openings 161*a*1 and 161*a*2 and the protuberances 162*a*1 and 162*a*2 do not necessarily need to be formed at both the left and right sides of the sheet travel path. The openings 161*a*1 and 161*a*2 and the protuberances 162*a*1 and 162*a*2 can be formed at only one of the left and right sides.

Moreover, while, in the above-described embodiment, the sheet guide 161 is located on the upper side, and the sheet guide 162 is located on the lower side, with regard to the sheet conveyance path P, the location of the sheet guides 161 and 162 can be optionally changed as long as the sheet guide 161 and the sheet guide 162 face each other across the sheet conveyance path P. For example, the sheet guide 161 can be located at the lower side and the sheet guide 162 can be located at the upper side. If the sheet S is ejected upward or downward, the sheet guide 161 can be located at the front side and the sheet guide 162 can be located at the rear side. Moreover, the sheet guide 161 can be located at the rear side and the sheet guide 162 can be located at the front side.

Furthermore, while, in the above-described embodiment, the sheet guides 161 and 162 are located in such a manner that the guide surfaces G1 and G2 each are inclined relative to the sheet conveyance path P, the guide surfaces G1 and G2 do not necessarily need to be inclined relative to the sheet conveyance path P. For example, the sheet guides 161 and 162 can be located in such a manner that the guide surfaces G1 and G2 are parallel to the sheet conveyance path P.

Additionally, the sheet guide 161 can be provided in the printer 10 in such a way as to be rotatable. For example, as long as the sheet gripping mechanism 16 has a shape illustrated in FIG. 5, the sheet guide 161 can be configured to be rotatable around a rotating shaft A. Then, when the sheet S is located between the sheet guide 161 and the sheet guide 162, the sheet guide 161 can use its own weight to apply clamping force onto the sheet S.

Furthermore, while, in the above-described embodiment, the discharge port 18 is formed in the side wall of the printer 10, the discharge port 18 may be formed to open toward the upward direction or toward the obliquely upward direction. In this case, the sheet gripping mechanism 16 can be arranged to grip the sheet S which is ejected in the upward direction or in the obliquely upward direction. Moreover, the discharge port 18 may be formed to open toward the downward direction or toward the obliquely downward direction. At this time, the sheet gripping mechanism 16 can be arranged to grip a sheet S which is ejected in the downward direction or in the obliquely downward direction.

Although in the above-described embodiment the printing unit 14 is a thermal-type print unit, the printing unit 14 is not limited to the thermal-type print unit. For example, the printing unit 14 can be a dot impact-type, inkjet-type, or electrophotographic-type print unit.

Moreover, while, in the above-described embodiment, the printer 10 is fixed to or incorporated in the merchandise information processing apparatus 1, the printer 10 can be configured to be externally attachable to the merchandise information processing apparatus 1. For example, the printer 10 can be equipped with a connection interface, such as a Universal Serial Bus (USB), and can be configured to be connectable to the merchandise information processing apparatus 1 via a communication cable, such as a USB cable.

The printer 10 can also be equipped with a user interface and can be configured to be able to operate independently of the merchandise information processing apparatus 1. Additionally, the printer 10 can be connected to a personal computer and can be configured to operate based on an instruction from the personal computer.

Furthermore, while, in the above-described embodiment, the printer 10 is equipped with the notification unit 12, the printer 10 does not need to be equipped with the notification unit 12.

Furthermore, while, in the above-described embodiment, the merchandise information processing apparatus 1 is a POS terminal, the merchandise information processing apparatus 1 is not limited to the POS terminal. For example, the merchandise information processing apparatus 1 can be a stand-alone type cash register which does not have a network connection function.

Moreover, while, in the above-described embodiment, the printer 10 is installed at a POS terminal or a stand-alone type cash register, the apparatus at which the printer 10 is installed is not limited to these. For example, the apparatus at which the printer 10 is installed can be a financial information processing apparatus. The financial information processing apparatus can be an automated teller machine (ATM) in a bank. At this time, the merchandise information processing apparatus 1 can be reworded as a "financial information processing apparatus 1". Naturally, the apparatus at which the printer 10 is installed can be an apparatus other than the merchandise information processing apparatus and the financial information processing apparatus.

Furthermore, in the above-described embodiment, the merchandise information processing apparatus 1 or the financial information processing apparatus 1 has a configuration to which the printer 10 is fixed or in which the printer 10 is incorporated. However, the merchandise information processing apparatus 1 or the financial information processing apparatus 1 can be configured to be able to directly perform printing on the sheet S without involving the printer 10. For example, the merchandise information processing apparatus 1 or the financial information processing apparatus 1 can include the communication interface 11, the notification unit 12, the control unit 13, the printing unit 14, the cutting unit 15, and the sheet gripping mechanism 16. The control unit 13 can be used in common with a control device (for example, a processor) which controls each unit of the merchandise information processing apparatus 1 or the financial information processing apparatus 1. The merchandise information processing apparatus 1 or the financial information processing apparatus 1 can be regarded as the printer 10 itself.

Additionally, while, in the description of the above-described embodiment, the printer 10 is a receipt printer, the printer 10 is not limited acting as a receipt printer. For example, the printer 10 can be a label printer. At this time, a roll of paper PR to be stored in the printer 10 can be a roll of paper for label printing in which a label printing sheet is rolled. Naturally, the printer 10 can be a printer other than the receipt printer and the label printer. For example, the printer 10 can be a printer that performs printing on a list of particulars (for example, a bank statement). Moreover, a printing medium on which the printer 10 performs printing is not limited to a continuous form sheet such as a roll of paper. For example, the printer 10 can be a printer that performs printing on a non-continuous form sheet, such as plain paper (for example, A4 size paper or B5 size paper). The non-continuous form sheet can be photo paper.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a sheet conveyer;

a print head configured to perform printing on a sheet conveyed by the sheet conveyer;

a sheet cutter provided downstream with respect to the print head in a sheet conveyance direction;

a sheet discharge port;

a sheet gripping mechanism provided between the sheet cutter and the sheet discharge port in the sheet conveyance direction; and a controller configured to control the sheet conveyer to convey the sheet to a predetermined position through the sheet gripping mechanism such that a leading end of the sheet in the sheet conveyance direction is out of the sheet discharge port, and control the sheet cutter to cut off a part of the sheet that has been conveyed to the predetermined position, wherein the sheet gripping mechanism is configured to hold the cut-off part of the sheet in a state in which a leading end of the cut-off part is out of the sheet discharge port, the sheet gripping mechanism includes a first sheet guide surface and a second sheet guide surface that face each other across a sheet conveyance path, the first sheet guide surface has a plurality of first protrusions arranged along the sheet conveyance direction and includes two second protrusions that are provided at a leading end of the sheet gripping mechanism and have a height higher than a height of the first protrusions, the second sheet guide surface has a plurality of third protrusions arranged along the sheet conveyance direction, the two second protrusions extend beyond the second sheet guide surface, and the two second protrusions are fixed to be apart from the second sheet guide surface, enabling the conveyance of the sheet between the two second protrusions and the second sheet guide surface.

2. The printer according to claim 1, wherein the first sheet guide surface and the second sheet guide surface are not in contact with each other before and after the leading end of the sheet conveyed by the sheet conveyer enters the sheet gripping mechanism.

3. The printer according to claim 1, wherein the second sheet guide surface includes an opening into which the two second protrusions extend into, and the opening includes a first edge and a second edge that are provided in a lateral direction crossing the sheet conveyance direction, such that the sheet conveyed through the sheet gripping mechanism by the sheet conveyer contacts the first edge and the second edge.

4. The printer according to claim 3, wherein the opening is provided at a center of the second sheet guide surface in the lateral direction.

5. The printer according to claim 3, wherein the sheet conveyed through the sheet gripping mechanism by the sheet conveyer does not contact the second sheet guide surface other than the first and second edges.

6. The printer according to claim 1, wherein the second sheet guide surface includes a first end and a second end in a lateral direction crossing the sheet conveyance direction, and the one of the two second protrusions is provided outside the first end in the lateral direction and the other one of the two second protrusions is provided outside the second end in the lateral direction, such that the sheet conveyed through the sheet gripping mechanism by the sheet conveyer contacts a first edge at the first end and a second edge at the second end.

7. The printer according to claim 6, wherein the sheet conveyed through the sheet gripping mechanism by the sheet conveyer does not contact the second sheet guide surface other than the first edge at the first end and the second edge at the second end.

8. The printer according to claim 1, wherein the two second protrusions face upward.

9. A sheet processing apparatus comprising:

a sheet conveyer;

a sheet discharge port;

a sheet gripping mechanism provided upstream with respect the sheet discharge port in a sheet conveyance direction; and a controller configured to control the sheet conveyer to convey a sheet to a predetermined position through the sheet gripping mechanism such that a leading end of the sheet in the sheet conveyance direction is out of the sheet discharge port, wherein the sheet gripping mechanism is configured to hold the sheet in a state in which a leading end of the sheet is out of the sheet discharge port, the sheet gripping mechanism includes a first sheet guide surface and a second sheet guide surface that face each other across a sheet conveyance path, the first sheet guide surface has a plurality of first protrusions arranged along the sheet conveyance direction and includes two second protrusions that are provided at a leading end of the sheet gripping mechanism and have a height higher than a height of the first protrusions, the second sheet guide surface has a plurality of third protrusions arranged along the sheet conveyance direction, the two second protrusions extend beyond the second sheet guide surface, and the two second protrusions are fixed to be apart from the second sheet guide surface, enabling the conveyance of the sheet between the two second protrusions and the second sheet guide surface.

10. The sheet processing apparatus according to claim 9, wherein the first sheet guide surface and the second sheet guide surface are not in contact with each other before and after the leading end of the sheet conveyed by the sheet conveyer enters the sheet gripping mechanism.

11. The sheet processing apparatus according to claim 9, wherein the second sheet guide surface includes an opening into which the two second protrusions extend into, and the opening includes a first edge and a second edge that are provided in a lateral direction crossing the sheet conveyance direction, such that the sheet conveyed through the sheet gripping mechanism by the sheet conveyer contacts the first edge and the second edge.

12. The sheet processing apparatus according to claim 11, wherein the opening is provided at a center of the second sheet guide surface in the lateral direction.

13. The sheet processing apparatus according to claim 11, wherein the sheet conveyed through the sheet gripping mechanism by the sheet conveyer does not contact the second sheet guide surface other than the first and second edges.

14. The sheet processing apparatus according to claim 9, wherein the second sheet guide surface includes a first end and a second end in a lateral direction crossing the sheet conveyance direction, and the one of the two second protrusions is provided outside the first end in the lateral direction and the other one of the two second protrusions is provided outside the second end in the lateral direction, such that the sheet conveyed through the sheet gripping mechanism by the sheet conveyer contacts a first edge at the first end and a second edge at the second end.

15. The sheet processing apparatus according to claim 14, wherein the sheet conveyed through the sheet gripping mechanism by the sheet conveyer does not contact the second sheet guide surface other than the first edge at the first end and the second edge at the second end.

16. The sheet processing apparatus according to claim 9, wherein the two second protrusions face upward.

* * * * *